US010056737B2

(12) United States Patent
Burrows et al.

(10) Patent No.: US 10,056,737 B2
(45) Date of Patent: Aug. 21, 2018

(54) CORONA IGNITION DEVICE AND ASSEMBLY METHOD

(71) Applicant: Federal-Mogul Ignition Company, Southfield, MI (US)

(72) Inventors: John Antony Burrows, Chesire (GB); John E. Miller, Temperance, MI (US); Kristapher I. Mixell, Plymouth, MI (US); James D. Lykowski, Temperance, MI (US)

(73) Assignee: Federal-Mogul LLC, Southfield, MI (US)

( * ) Notice: Subject to any disclaimer, the term of this patent is extended or adjusted under 35 U.S.C. 154(b) by 14 days.

(21) Appl. No.: 15/240,502

(22) Filed: Aug. 18, 2016

(65) Prior Publication Data

US 2016/0359301 A1 Dec. 8, 2016

Related U.S. Application Data

(63) Continuation-in-part of application No. 14/742,064, filed on Jun. 17, 2015, which is a continuation of (Continued)

(51) Int. Cl.
*H01T 13/50* (2006.01)
*H01T 19/00* (2006.01)

(Continued)

(52) U.S. Cl.
CPC ..... *H01T 13/50* (2013.01); *F02P 3/01* (2013.01); *F02P 23/04* (2013.01); *F02P 23/045* (2013.01);

(Continued)

(58) Field of Classification Search
CPC ..... H01T 13/50; H01T 13/36; H01T 21/00; H01T 21/02; H01T 19/00; H01T 19/04;

(Continued)

(56) References Cited

U.S. PATENT DOCUMENTS 1,186,221 A 6/1916 Mosler
1,205,441 A 11/1916 Eastman (Continued)

FOREIGN PATENT DOCUMENTS

EP 1515408 A 3/2005
JP 2008535195 A 8/2008

(Continued)

OTHER PUBLICATIONS

International Search Report, dated Nov. 23, 2016 (PCT/US2016/047678).

(Continued)

*Primary Examiner* — Joseph Dallo
(74) *Attorney, Agent, or Firm* — Robert L. Stearns; Dickinson Wright, PLLC

(57) ABSTRACT

A reversed-assembled corona igniter including an insulator, central electrode, and metal shell, wherein an outer diameter of the insulator increases adjacent a lower end of the metal shell to achieve an electrical advantage is provided. In addition, the insulator maintains strength because is not placed under tension during or after assembly, or once disposed in an engine. To achieve the increase in insulator outer diameter, the insulator includes a lower shoulder adjacent the shell firing end. An intermediate part, such as braze and/or a metal ring, is disposed between the insulator outer surface and the shell adjacent the shell firing end. To prevent tension in the insulator, the insulator can be supported at only one location between the insulator upper end and the insulator lower end, for example along the intermediate part.

22 Claims, 14 Drawing Sheets

Related U.S. Application Data application No. 13/843,336, filed on Mar. 15, 2013, now Pat. No. 9,088,136.

(60) Provisional application No. 62/207,688, filed on Aug. 20, 2015, provisional application No. 61/614,808, filed on Mar. 23, 2012.

(51) Int. Cl.

| | |
|---|---|
| ***H01T 21/02*** | (2006.01) |
| ***F02P 3/01*** | (2006.01) |
| ***F02P 23/04*** | (2006.01) |
| ***H01T 21/00*** | (2006.01) |
| ***H01T 13/36*** | (2006.01) |
| *H01T 19/02* | (2006.01) |
| *H01T 19/04* | (2006.01) |

(52) U.S. Cl.

CPC ..... *H01T 13/36* (2013.01); *H01T 19/00* (2013.01); *H01T 21/00* (2013.01); *H01T 21/02* (2013.01); *H01T 19/02* (2013.01); *H01T 19/04* (2013.01); *Y10T 29/49002* (2015.01); *Y10T 29/49227* (2015.01)

(58) Field of Classification Search

CPC ..... H01T 19/02; F02P 23/045; F02P 23/04; F02P 3/01; Y10T 29/49002; Y10T 29/49227

See application file for complete search history.

(56) References Cited

U.S. PATENT DOCUMENTS

| | | | | |
|---|---|---|---|---|
| 1,237,265 | A | 8/1917 | Eastman | |
| 1,610,032 | A | 12/1926 | Beason | |
| 1,968,225 | A | 7/1934 | Shell et al. | |
| 2,356,102 | A | 8/1944 | Tognola | |
| 2,394,865 | A | 2/1946 | McCarthy et al. | |
| 3,488,545 | A | 1/1970 | Wright | |
| 4,493,297 | A | 1/1985 | McIlwain et al. | |
| 7,928,642 | B2 | 4/2011 | Malek et al. | |
| 8,468,992 | B2 | 6/2013 | Ruan et al. | |
| 8,550,048 | B2 | 10/2013 | Stifel et al. | |
| 2008/0054777 | A1 | 3/2008 | Callahan et al. | |
| 2008/0284303 | A1 | 11/2008 | Agneray et al. | |
| 2009/0189504 | A1 | 7/2009 | Malek et al. | |
| 2010/0052497 | A1 | 3/2010 | Walker, Jr. et al. | |
| 2010/0083942 | A1 | 4/2010 | Lykowski et al. | |
| 2011/0146640 | A1 | 6/2011 | Achstaetter et al. | |
| 2011/0163654 | A1 | 7/2011 | Malek et al. | |
| 2011/0247579 | A1 | 10/2011 | Hampton et al. | |
| 2011/0253089 | A1 | 10/2011 | Braeuchle et al. | |
| 2012/0274200 | A1* | 11/2012 | Gfell | H01T 13/08 313/141 |
| 2013/0234581 | A1 | 9/2013 | Makarov et al. | |
| 2013/0340697 | A1* | 12/2013 | Burrows | H01T 13/50 123/146.5 R |
| 2014/0327999 | A1* | 11/2014 | Durham | H01T 19/04 361/230 |
| 2014/0328003 | A1 | 11/2014 | Achtstatter et al. | |
| 2015/0114332 | A1 | 4/2015 | Stifel et al. | |
| 2015/0285206 | A1 | 10/2015 | Burrows et al. | |
| 2016/0049773 | A1 | 2/2016 | Stifel et al. | |

FOREIGN PATENT DOCUMENTS

| | | | |
|---|---|---|---|
| JP | 2009512172 | A | 3/2009 |
| JP | 2011129511 | A | 6/2011 |
| JP | 2012501521 | A | 1/2012 |
| JP | 2012512980 | A | 6/2012 |
| JP | 2013524478 | A | 6/2013 |
| JP | 2014501432 | A | 1/2014 |
| WO | 201002053 | A2 | 3/2010 |
| WO | 2010025053 | A2 | 3/2010 |

OTHER PUBLICATIONS

International Search Report, dated Nov. 8, 2017 (PCT/US2017/046420).

* cited by examiner

CORONA IGNITION DEVICE AND ASSEMBLY METHOD

CROSS-REFERENCE TO RELATED APPLICATIONS

This U.S. continuation-in-part application claims the benefit of U.S. provisional patent application No. 62/207,688, filed Aug. 20, 2015, and U.S. continuation application Ser. No. 14/742,064, filed Jun. 17, 2015, which claims the benefit of U.S. application Ser. No. 13/843,336, filed Mar. 15, 2013, which claims the benefit of U.S. provisional application Ser. No. 61/614,808, filed Mar. 23, 2012, the entire contents of which are hereby incorporated by reference.

BACKGROUND OF THE INVENTION

1. Field of the Invention

This invention relates generally to a corona igniter for emitting a radio frequency electric field to ionize a fuel-air mixture and provide a corona discharge, and a method of forming the igniter.

2. Related Art

Corona discharge ignition systems include an igniter with a central electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create a thermal plasma and an electric arc between the electrode and grounded cylinder walls, piston, or other portion of the igniter. An example of a corona discharge ignition system is disclosed in U.S. Pat. No. 6,883,507 to Freen.

The central electrode of the corona igniter is formed of an electrically conductive material for receiving the high radio frequency voltage and emitting the radio frequency electric field to ionize the fuel-air mixture and provide the corona discharge. The electrode typically includes a high voltage corona-enhancing electrode tip emitting the electrical field. The igniter also includes a shell formed of a metal material, and an insulator formed of an electrically insulating material disposed between the shell and the central electrode. The igniter of the corona discharge ignition system does not include any grounded electrode element intentionally placed in close proximity to a firing end of the central electrode. Rather, the ground is preferably provided by cylinder walls or a piston of the ignition system. An example of a corona igniter is disclosed in U.S. Patent Application Publication No. 2010/0083942 to Lykowski and Hampton.

During operation of high frequency corona igniters, there is an electrical advantage if the outer diameter of the insulator increases in a direction moving away from the grounded metal shell and towards the high voltage electrode tip. An example of this design is disclosed in U.S. Patent Application Publication No. 2012/0181916. For maximum benefit, it is often desirable to make the outer diameter of the insulator larger than the inner diameter of the grounded metal shell. This design has resulted in the need to assemble the igniter by inserting the insulator into the shell from the direction of the combustion chamber, referenced to as "reverse-assembly". However, the reverse-assembly method leads to a range of operational and manufacturing compromises which may be unacceptable. For example, when disposing the assembly in an internal combustion engine, it is difficult to retain the insulator in the shell without putting the insulator in tension. Typically, the tension in the insulator increases once the assembly is installed in the engine.

SUMMARY OF THE INVENTION

One aspect of the invention provides a reverse-assembled corona igniter for emitting a radio frequency electric field to ionize a fuel-air mixture and provide a corona discharge.

The corona igniter includes a central electrode formed of an electrically conductive material for receiving a high radio frequency voltage and emitting the radio frequency electric field. An insulator formed of an electrically insulating material surrounds a central electrode. The corona igniter is designed so that the insulator is not in tension during assembly or once installed in an engine. The insulator extends longitudinally from an insulator upper end to an insulator nose end. The insulator also includes an insulator outer surface extending from the insulator upper end to the insulator nose end, and the insulator outer surface presents an insulator outer diameter. The insulator outer surface includes an insulator lower shoulder extending outwardly and located between the insulator upper end and the insulator nose end, and the insulator lower shoulder presents an increase in the insulator outer diameter. A shell surrounds at least a portion of the insulator and extends from a shell upper end to a shell firing end. The shell presents a shell inner surface facing and extending along the insulator outer surface from the shell upper end to the shell firing end. The shell inner surface presents a shell inner diameter, and the shell inner diameter of at least one location of the shell is less than the insulator outer diameter at the insulator lower shoulder. An intermediate part formed of an electrically conductive material is disposed between the insulator outer surface and the shell inner surface and between the insulator upper end and the insulator lower shoulder.

A method of forming a corona igniter, specifically a reverse-assembly method, is also provided. The method includes providing an insulator formed of an electrically insulating material extending from an insulator upper end to and insulator nose end. The insulator includes an insulator outer surface extending from the insulator upper end to the insulator nose end and presents an insulator outer diameter. The insulator outer surface presents an insulator lower shoulder extending outwardly and located between the insulator upper end and the insulator nose end, and the insulator lower shoulder presents an increase in the insulator outer diameter. The method also includes providing a shell extending from a shell upper end to a shell firing end and including a shell inner surface presenting a shell bore. The shell inner surface presents a shell inner diameter, and the shell inner diameter of at least one location of the shell is less than the insulator outer diameter at the insulator lower shoulder. The method further includes inserting the insulator upper end into the shell bore through the shell firing end; and disposing an intermediate part formed of an electrically conductive material between the insulator outer surface and the shell inner surface.

The corona igniter of the present invention provides exceptional electrical performance because of the increased insulator outer diameter at the insulator lower shoulder. In addition, since the insulator remains not under tension, it can achieve a greater strength than insulators under tension.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF EXAMPLE EMBODIMENTS

Figure 16A:
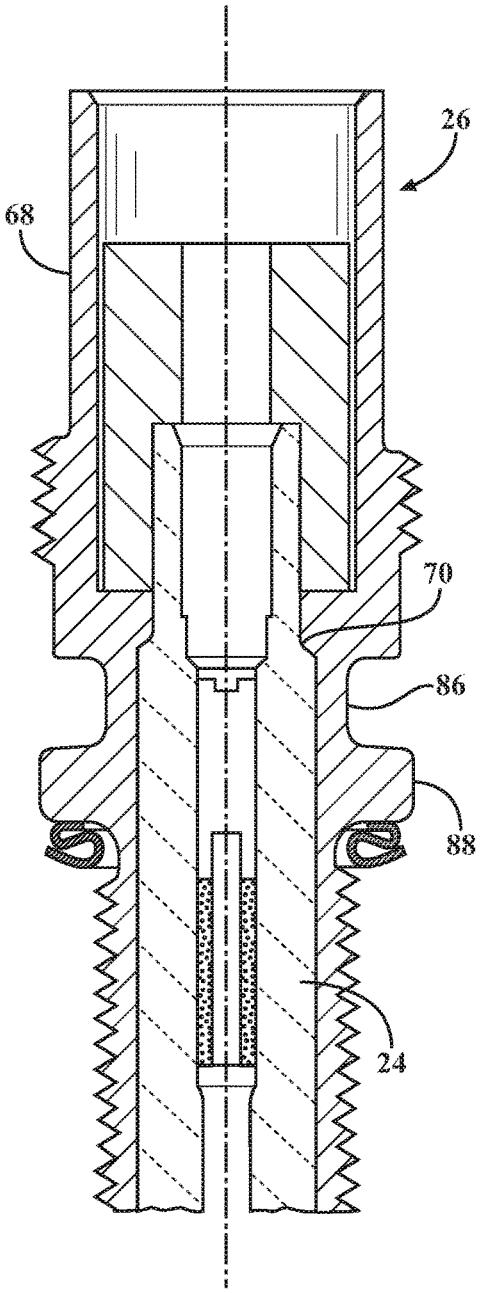
Figure 16B:
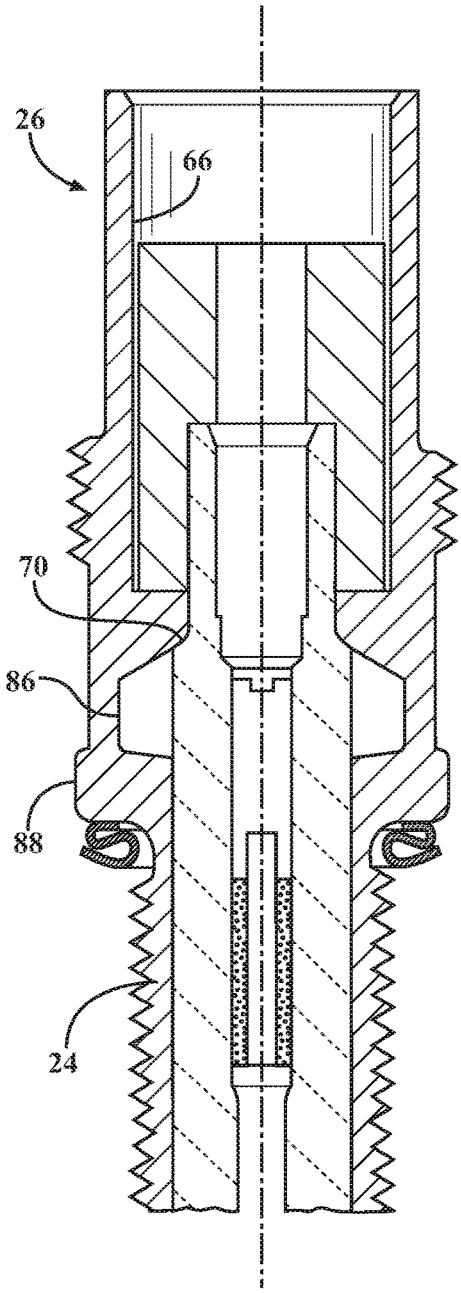
Figure 17:
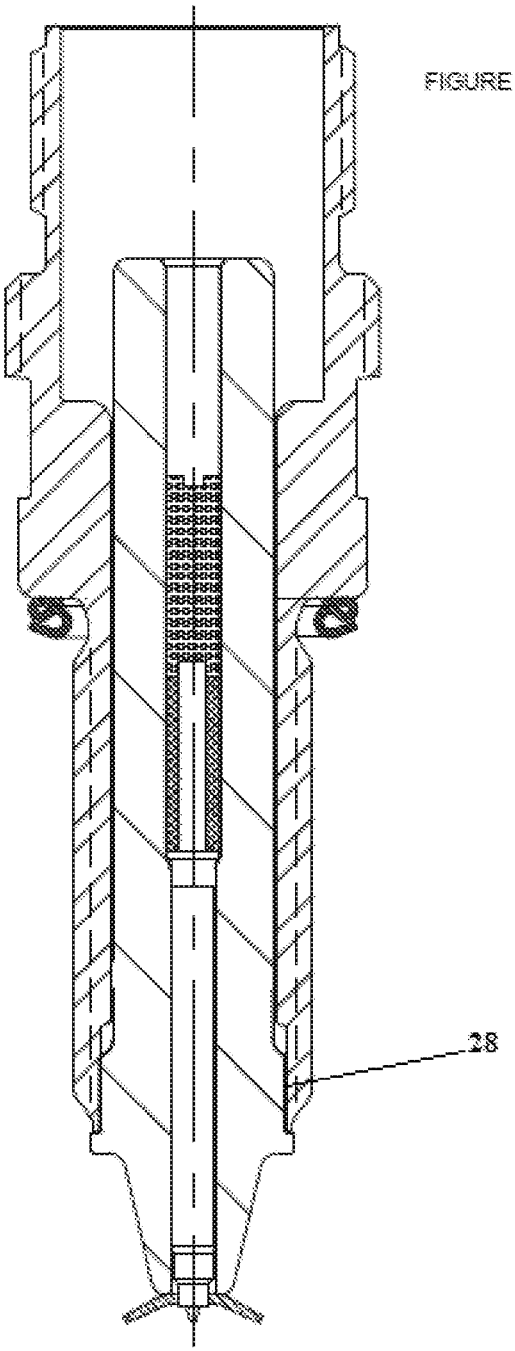
FIG. 17 is a cross-sectional view of another reverse-assembled corona igniter according an example embodiment wherein the insulator is not under compression or tension.

Example embodiments of a reverse-assembled corona igniter 20 for receiving a high radio frequency voltage and emitting a radio frequency electric field to ionize a fuel-air mixture and provide a corona discharge in a combustion chamber of an internal combustion engine are shown in FIGS. 1-17. The corona igniter 20 includes a central electrode 22 receiving the high radio frequency voltage and emitting the radio frequency electric field, an insulator 24 surrounding the central electrode 22, and a conductive component surrounding the insulator 24. The conductive component includes a metal shell 26 and optionally includes an intermediate part 28. In several embodiments, such as those of FIGS. 1-9, the conductive component and insulator 24 are arranged such that the insulator 24 is under compression to increase the strength of the insulator 24 compared to an insulator is placed in tension. In the embodiment of FIG. 17, the insulator 24 is not under compression or tension, and thus also has an increased strength compared to an insulator placed in tension.

As shown in the Figures, the central electrode 22 of the corona igniter 20 extends longitudinally along a center axis A from a terminal end 30 to an electrode firing end 32. The central electrode 22 is formed of an electrically conductive material for receiving the high radio frequency voltage, typically in the range of 20 to 75 KV peak/peak, and emitting the high radio frequency electric field, typically in the range of 0.8 to 1.2 MHz. In the example embodiments, the central electrode 22 includes a corona enhancing tip 34 at the electrode firing end 32, for example a tip including a plurality of prongs, as shown in FIGS. 1-10 and 17. The terminal end 30 of the central electrode 22 is typically connected to an electrical terminal 36, which is ultimately connected to an ignition coil (not shown). The ignition coil is connected to an energy source providing the high radio frequency voltage.

The insulator 24 of the corona igniter 20 also extends longitudinally along the center axis A from an insulator upper end 38 to an insulator nose end 40. The insulator 24 typically surrounds the central electrode 22 such that the electrode firing end 32 is disposed outwardly of the insulator nose end 40, as shown in FIGS. 1-10 and 17. An insulator inner surface 42 surrounds a bore receiving the central electrode 22. A seal 44 is disposed in the bore around the electrical terminal 36 to secure the central electrode 22 to the electrical terminal 36.

The insulator inner surface 42 presents an insulator inner diameter $D_{ii}$ extending across and perpendicular to the center axis A. The insulator 24 also includes an insulator outer surface 46 extending from the insulator upper end 38 to the insulator nose end 40. The insulator outer surface 46 presents an insulator outer diameter $D_{i0}$ extending across and perpendicular to the center axis A. The insulator inner diameter $D_{ii}$ is preferably 15 to 40% of the insulator outer diameter $D_{i0}$.

Figure 7:
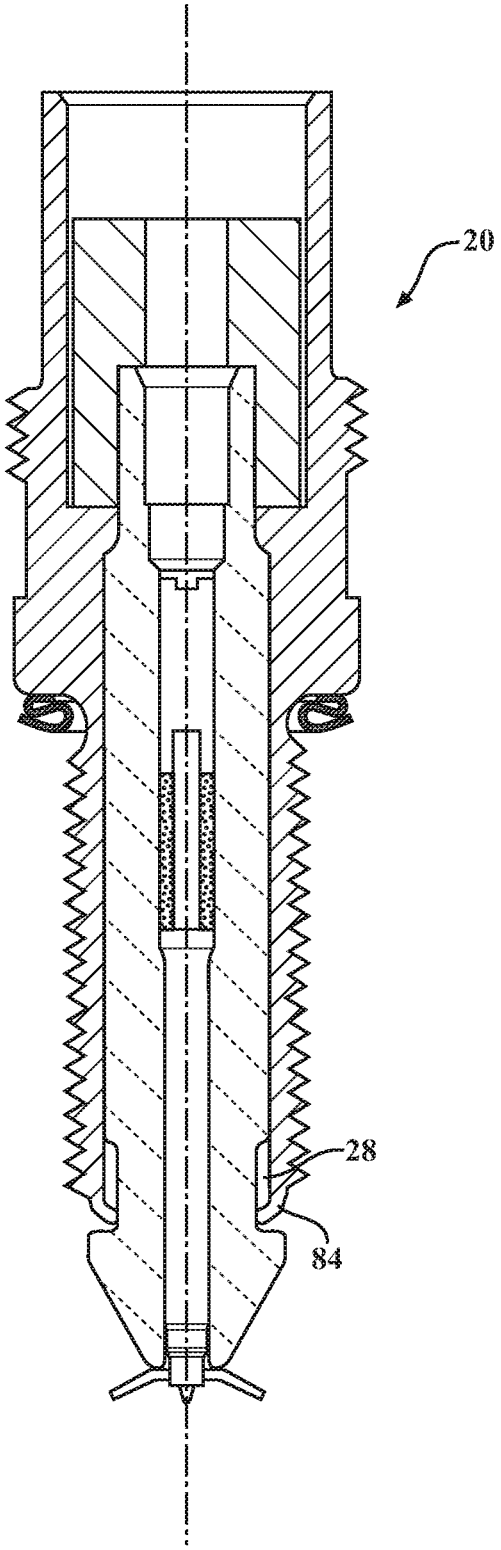
Figure 8:
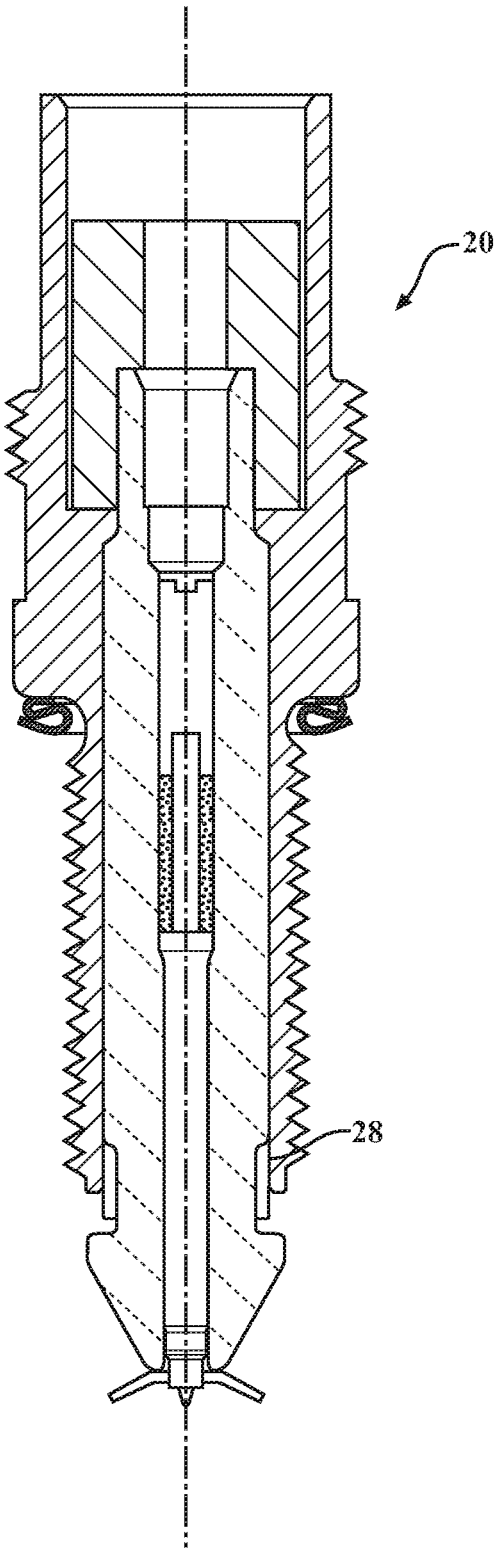
Figure 9:
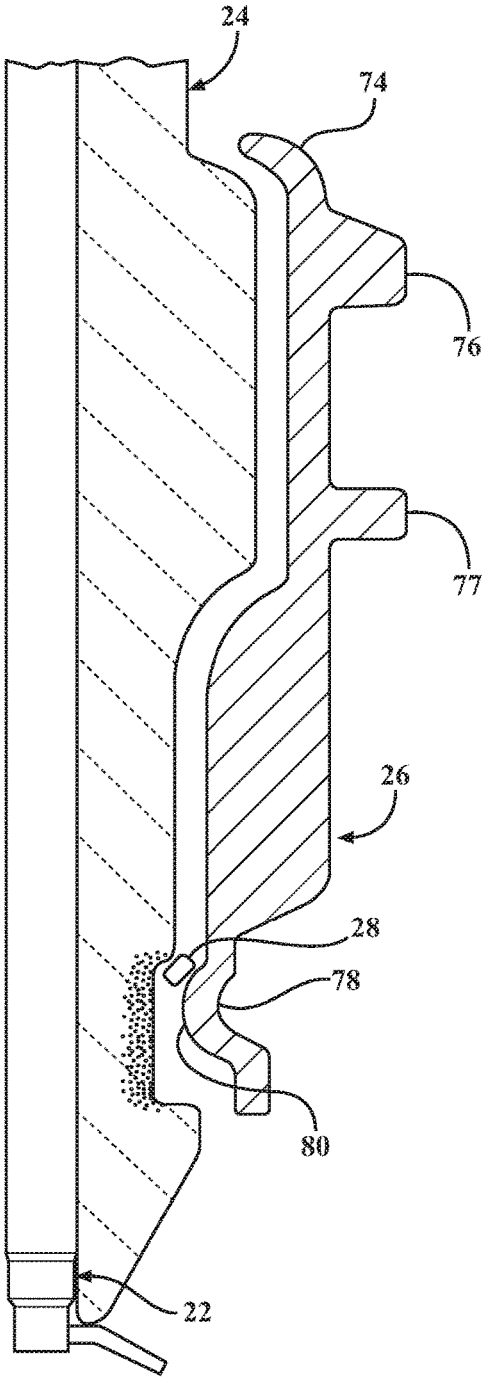
FIGS. 9-16 are cross-sectional views of portions of corona igniters according to other example embodiments where an insulator is in compression and not under tension.

In the embodiments of FIGS. 1-9, the insulator outer surface 46 presents an insulator upper shoulder 48 and an insulator lower shoulder 50 each located between the insulator upper end 38 and the insulator nose end 40 and each extending radially relative to the center axis A. Both the upper and lower insulator shoulders 48, 50 face toward the insulator upper end 38 and present an increase in the insulator outer diameter $D_{i0}$. The increase in insulator outer diameter $D_{i0}$ at the insulator lower shoulder 50 is typically greater than the increase at the insulator upper shoulder 48, as shown in FIGS. 1-8. Alternatively, the increase in the insulator outer diameter $D_{i0}$ could be greater at the insulator lower shoulder 50, as shown in FIG. 9.

In the embodiment of FIG. 17, the insulator 24 extends longitudinally from the insulator upper end 38 to the insulator upper shoulder 48 and then from the insulator upper shoulder 48 to the insulator lower shoulder 50. In this embodiment, the insulator outer diameter $D_{i0}$ is constant from the insulator upper end 38 to the insulator upper shoulder 48. The upper shoulder 48 presents an increase in the insulator outer diameter $D_{i0}$ in a direction moving from the insulator upper end 38 toward the insulator nose end 40, such that the insulator outer diameter $D_{i0}$ is greater at the insulator upper shoulder 40 than at the insulator upper end 38. The insulator outer diameter $D_{i0}$ is also constant from the insulator upper shoulder 48 to the insulator lower shoulder 50. The insulator lower shoulder 50 presents another increase in the insulator outer diameter $D_{i0}$ in a direction moving from the insulator upper end 38 toward the insulator nose end 40, such that the insulator outer diameter $D_{i0}$ is greater at the insulator lower shoulder 50 than at the insulator upper shoulder 48. The insulator outer diameter $D_{i0}$ then decreases from the insulator lower shoulder 50 to the insulator nose end 40. As will be discussed further below, the insulator 24 of this embodiment is supported in only one location, specifically in the location between the insulator upper shoulder 48 and the insulator lower shoulder 50. Thus, the insulator 24 is not in tension or in compression during assembly, after assembly or once disposed in the engine.

Figure 1:
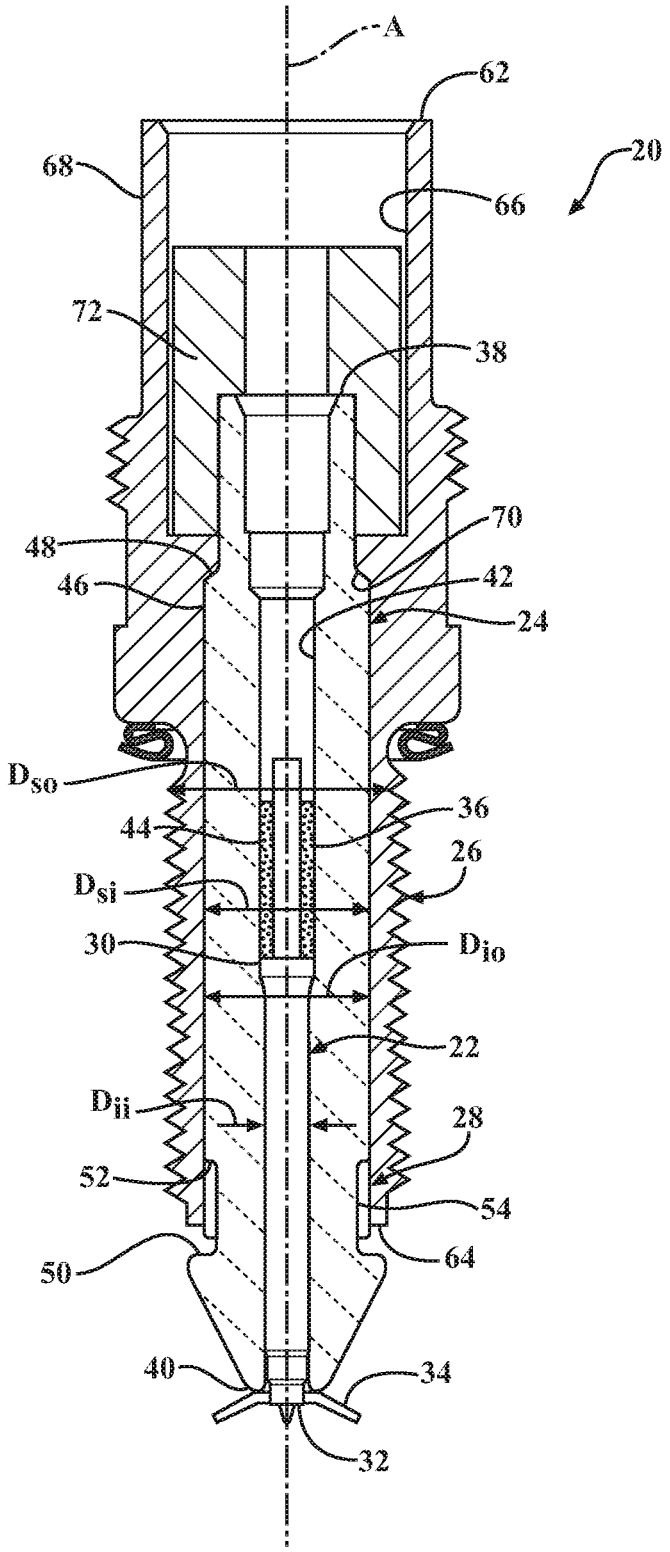
FIGS. 1-8 are cross-sectional views of reverse-assembled corona igniters according to example embodiments wherein an insulator is in compression and no under tension.
Figure 5:
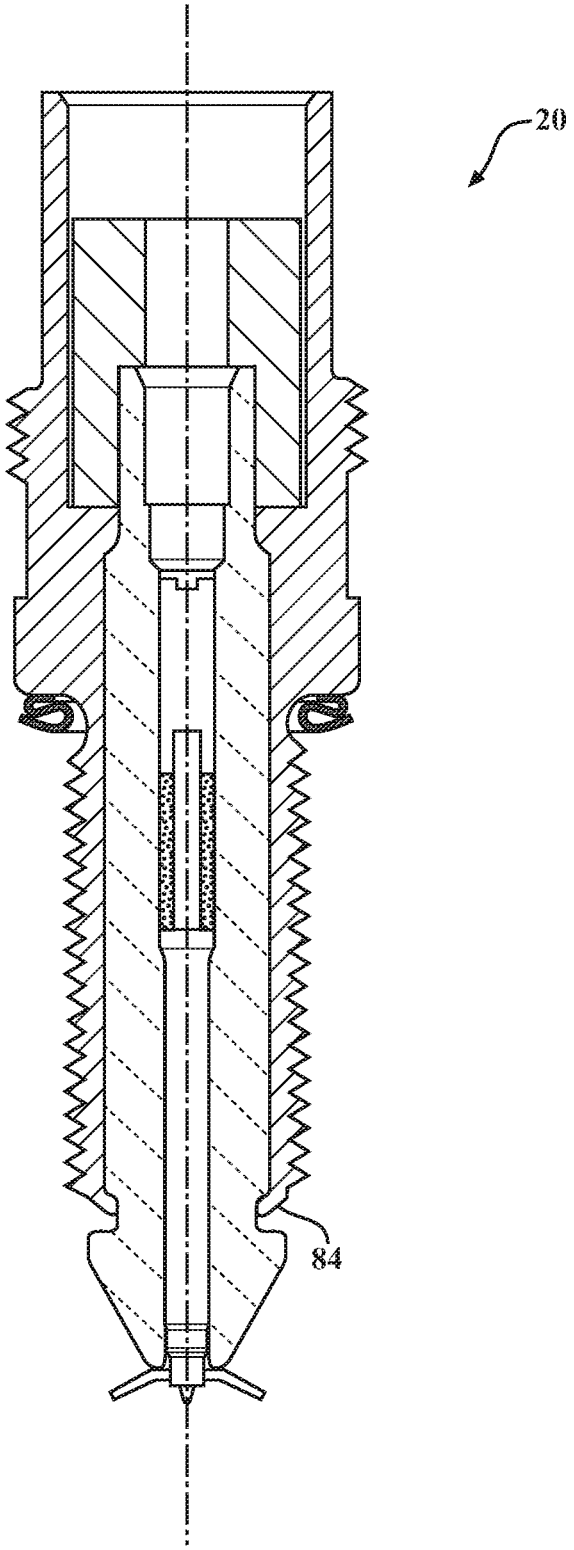
Figure 6:
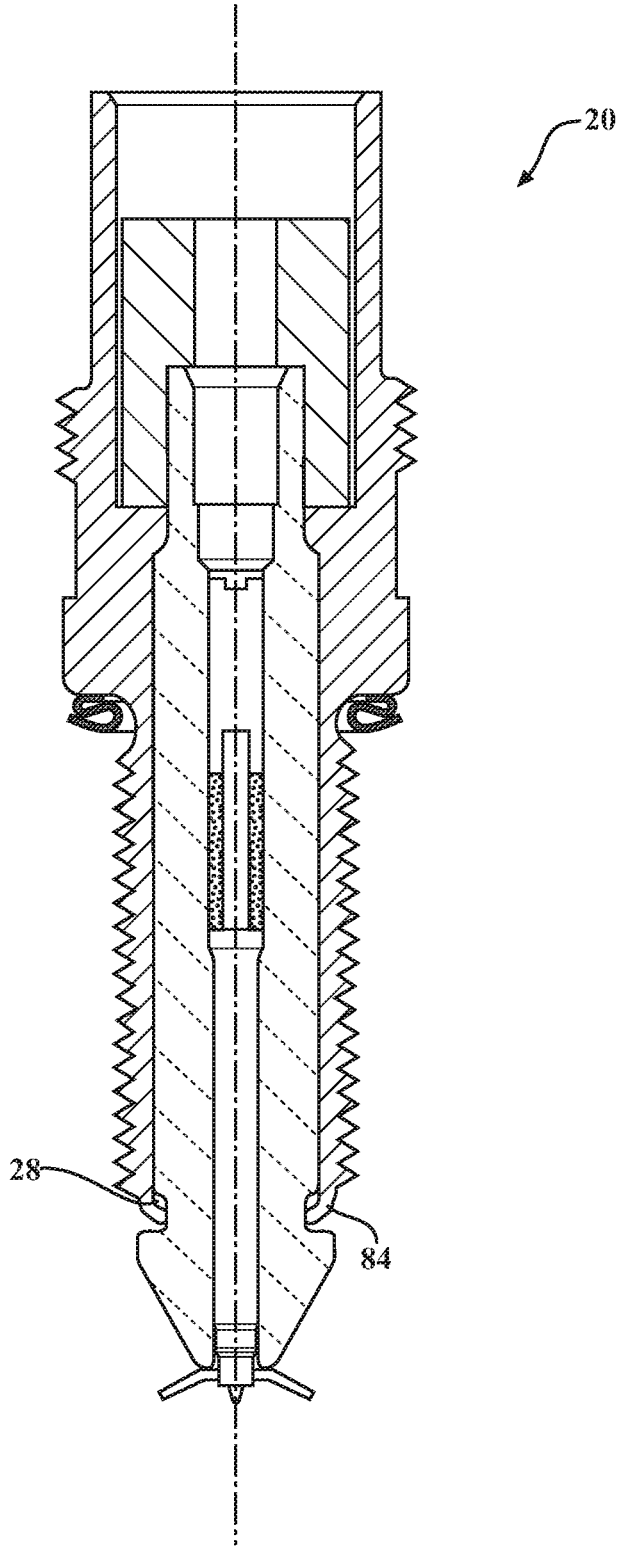

In certain embodiments, as shown in FIGS. 1, 2 and 4-8, the insulator outer diameter $D_{i0}$ decreases (in a direction moving from the insulator upper end 38 toward the insulator nose end 40) to present a middle ledge 52 located between the insulator upper shoulder 48 and the insulator lower shoulder 50, before the insulator outer diameter $D_{i0}$ increases again at the insulator lower shoulder 50. For example, the insulator 24 could include an insulator groove 54 between the middle ledge 52 and the insulator lower shoulder 50. The insulator groove 54 can present a concave profile and can extend various lengths and depths. For example, the insulator groove 54 of FIGS. 1, 7, and 8 is longer than the insulator grooves 54 of FIGS. 2 and 4-6. In the embodiment of FIG. 3, instead of the insulator groove 54, the insulator outer surface 46 presents a plurality of ribs 56 with depressions 58 therebetween, as best shown in FIG. 3A. The ribs 56 and depressions 58 are located adjacent the insulator lower shoulder 50.

Figure 10:
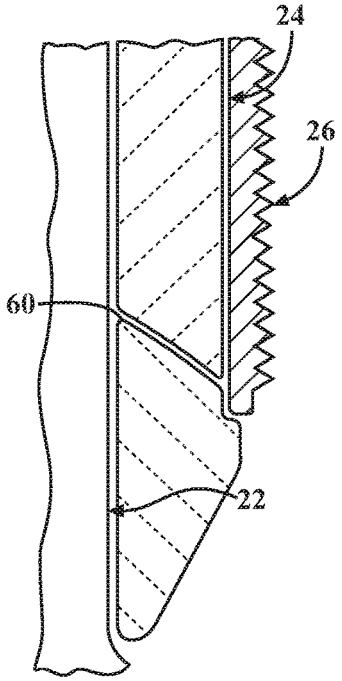
Figure 11:
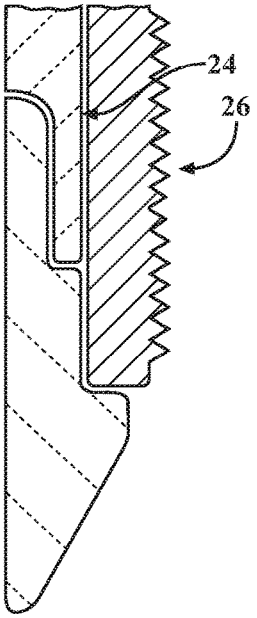
Figure 12:
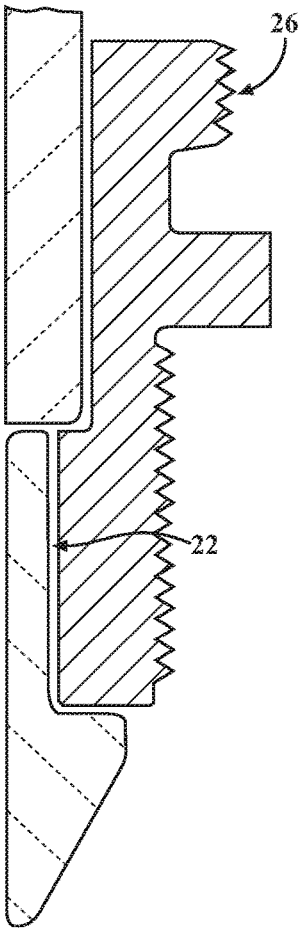

The insulator 24 can be formed of a single piece or multiple pieces of insulating material, such as alumina or another ceramic. In the embodiments of FIGS. 1-9, the insulator 24 is formed of a single piece of material. In the embodiments of FIGS. 10-12, however, the insulator 24 is formed of two pieces of material. The two pieces are typically press-fit and then further secured together using a glass seal 60. In the embodiment of FIG. 10, the central electrode 22 is positioned to support the insulator nose end 40. In the embodiments of FIGS. 11 and 12, the second piece extending from the insulator upper end 38 toward the insulator nose end 40 can be provided as an outer mold or separate cap end.

The conductive component of the corona igniter 20 surrounds at least a portion of the insulator 24 such that an insulator nose region located adjacent the insulator nose end 40 extends outwardly of the conductive component, as shown in the Figures. The conductive component includes the shell 26 and may include the intermediate part 28. The shell 26 and the intermediate part 28 can be formed of the same or different electrically conductive materials. For example, the shell 26 can be formed of steel and the intermediate part 28 can be formed of metal or metal alloy containing one or more of nickel, cobalt, iron, copper, tin, zinc, silver, and gold.

The shell 26 of the corona igniter 20 extends along the center axis A from a shell upper end 62 to a shell firing end 64. The shell 26 presents a shell inner surface 66 facing the center axis A and extending along the insulator outer surface 46 from the shell upper end 62 to the shell firing end 64. The shell 26 also includes a shell outer surface 68 facing opposite the shell inner surface 66 and presenting a shell outer diameter $D_{s0}$. The shell inner surface 66 presents a bore surrounding the center axis A and a shell inner diameter $D_{si}$ extending across and perpendicular to the center axis A.

As shown in FIGS. 1-8 and 17, the shell inner surface 66 typically presents a shell upper shoulder 70 extending radially relative to the center axis A and located between the shell upper end 62 and the shell firing end 64. The shell upper shoulder 70 engages the insulator upper shoulder 48 to help place the insulator 24 in compression, and thus increase the strength of the insulator 24. In the embodiments of FIGS. 1-8, a flexible insulating element 72 is optionally disposed in the bore of the shell 26 above the shell upper shoulder 70 and surrounds the insulator upper end 38.

As shown in FIGS. 1-8, the shell inner diameter $D_{si}$ at the shell upper shoulder 70 is not greater than the insulator outer diameter $D_{i0}$ at the insulator upper shoulder 48, and thus the corona igniter 20 is reverse-assembled. The term "reverse-assembled" means that the insulator upper end 38 is inserted into the bore of the shell 26 through the shell firing end 64. Alternatively, the corona igniter 20 could be designed for forward-assembly. The term "forward-assembled" means that the insulator nose end 40 is inserted into the bore of the shell 26 through the shell upper end 62.

In the embodiment of FIG. 17, the shell inner diameter $D_{si}$ increases slightly above the insulator upper shoulder 48 to present the shell upper shoulder 70 and then remains constant from the shell upper shoulder 70 to the shell firing end 64. There is a gap located between the shell upper shoulder 48 and the insulator upper shoulder 48. The shell inner diameter $D_{si}$ at the shell firing end 64 is less than the insulator outer diameter $D_{i0}$ at the insulator lower shoulder 50, and the shell firing end 64 rests on the insulator lower shoulder 50. Thus, the corona igniter 20 of FIG. 17 must be reverse-assembled, in which case the insulator upper end 38 is inserted into through the shell firing end 64 until the shell firing end 64 engages the insulator upper shoulder 48.

Figure 14:
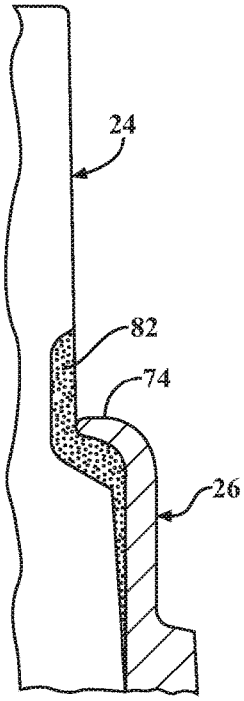

In the embodiments of FIGS. 9 and 14, the shell 26 includes an upper turnover flange 74 at the shell upper end 62, instead of the shell upper shoulder 70. The upper turnover flange 74 extends radially inwardly toward the center axis A and engages the insulator upper shoulder 48 to help place the insulator 24 in compression, and thus increase the strength of the insulator 24. In the embodiment of FIG. 9, the shell outer surface 68 presents a pair of shell ribs 76, 77 located near the shell upper end 62, and a notch 78 located adjacent the shell firing end 64. The upper shell rib 76 is referred to as a hexagon, and the lower shell rib 77 is referred to as a gasket seat. The shell ribs 76, 77 are spaced from one another by a groove, and the lower shell rib 77 is disposed directly above a threaded region of the shell 26. In this embodiment, the shell inner surface 66 presents a bead 80 located opposite the notch 78. In the embodiment of FIG. 14, a resin 82 is injection molded between the insulator 24 and upper turnover flange 74 of the shell 26.

Figure 15A:
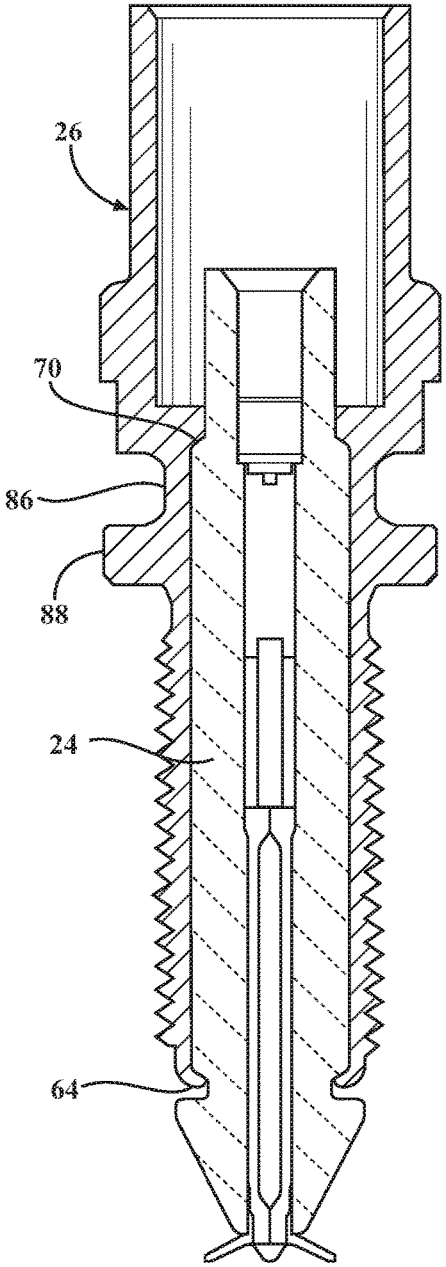
Figure 15B:
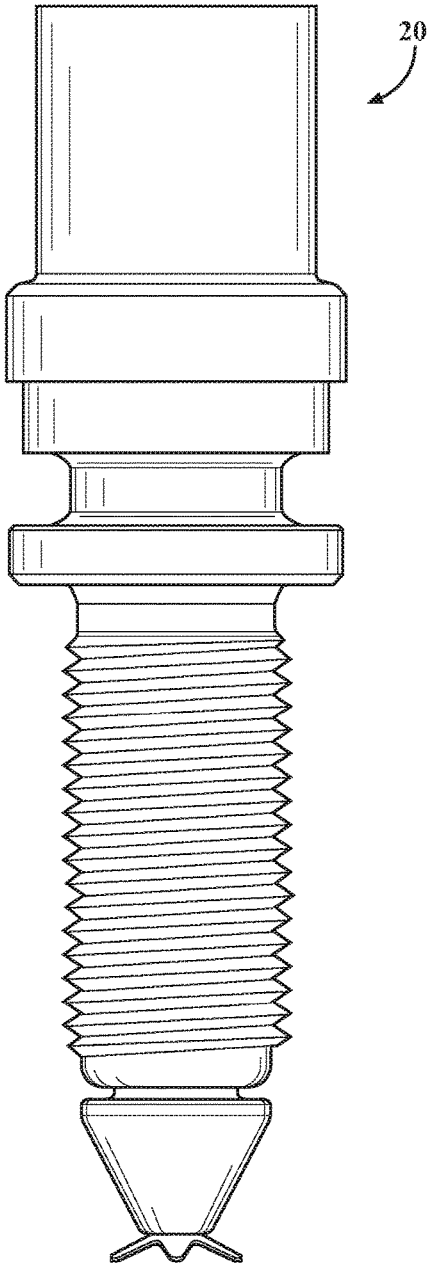

The shell 26 is also preferably designed with a groove 86 between the shell upper shoulder 70 and the shell firing end 64. The groove 86 presents a reduced thickness along a portion of the shell 26, which increases the flexibility of the shell 26. When the corona igniter 20 is inserted into the internal combustion engine, the shell 26 is able to stretch without placing tension on the insulator 24. FIGS. 15 and 16 show examples of reverse-assembled corona igniters 20 including the groove 86. In the example embodiments, the groove 86 is formed along a portion of the shell inner surface 66 or along the shell inner surface 68 above a gasket seat 88.

Figure 13:
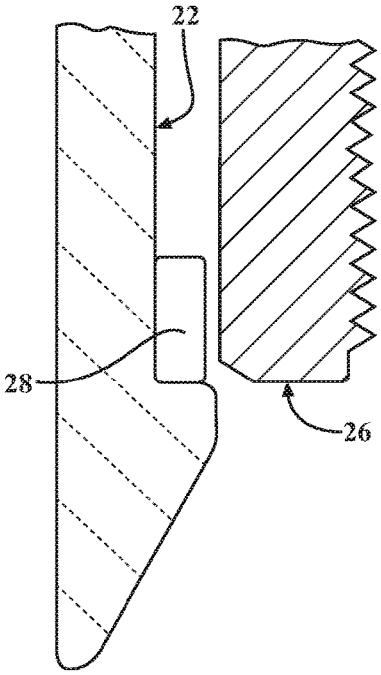

In addition to the upper turnover flange 74, the conductive component can also include the intermediate part 28 adjacent the shell firing end 64, as shown in FIGS. 1, 3, 6-8, 9, and 13 to help place the insulator 24 in compression. In the embodiment of FIG. 1, the intermediate part 28 is a split steel sleeve disposed in the insulator groove 54. In this embodiment, the intermediate part 28 engages the middle ledge 52 and is spaced from the insulator lower shoulder 50. Alternatively, the intermediate part 28 could engage the insulator lower shoulder 50 instead of, or in addition to, the middle ledge 52. The intermediate part 28 of FIG. 1 is also welded or brazed to the insulator 24 and/or the shell 26 adjacent the shell firing end 64 by a layer of metal. In the embodiment of FIG. 3, the intermediate part 28 is used to braze the insulator 24 to the shell 26 adjacent the insulator lower shoulder 50 and shell firing end 64. As best shown in FIG. 3A, the intermediate part 28 is a thin layer of metal disposed along the insulator ribs 56 and depressions 58. The layer of metal is applied in liquid form and then solidifies between the insulator 24 and shell 26. In the embodiment of FIG. 6, the intermediate part 28 is a split ring gasket disposed against the middle ledge 52 of the insulator 24 and the shell firing end 64. In the embodiment of FIG. 7, the intermediate part 28 is a split or solid copper insert disposed between the middle ledge 52 and the shell firing end 64. In the embodiment of FIG. 8, the intermediate part 28 is a solid or split steel sleeve engaging the middle ledge 52 adjacent the shell firing end 64. The steel sleeve is spaced from the insulator lower shoulder 50, like the steel sleeve of FIG. 1. In the embodiment of FIG. 8, the steel sleeve is laser welded or soldered to the shell 26 and/or insulator 24, for example by a silver solder. In the embodiment of FIG. 9, the intermediate part 28 is a gasket or copper ring and engages the middle ledge 52 of the insulator 24, and the insulator outer surface 46 is plated with metal along the insulator groove 54. In the embodiment of FIG. 13, the intermediate part 28 is formed of copper or a similar material and is press-fit against the insulator lower shoulder 50. The intermediate part 28 may include a solid piece of material, and then an additional braze or solder is applied to the solid piece to secure the solid piece to the insulator 24 and the shell 26. The intermediate part 28 of FIG. 13 is also attached to the shell inner surface 66, for example by brazing, welding, glue, solder, or press-fit.

In the embodiment of FIG. 17, the intermediate part 28 is a layer of metal which secures or brazes the insulator 24 to the metal shell 26. In the example embodiments, the metal contains one or more of nickel, cobalt, iron, copper, tin, zinc, silver, and gold. This layer of metal brazes the insulator 24 to the shell 26.

In another example embodiment, the intermediate part 28 is formed from a solid piece of metal, specifically a solid ring formed of a silver (Ag) and/or copper (Cu) alloy disposed around the insulator 24. Next, the shell 26 is disposed around the insulator 24, and the assembly is heated at which time the solid ring, referred to as a braze, becomes liquid and is wicked into an area, referred to as a "braze area," through capillary action. As the parts cool, the liquid alloy solidifies to provide the intermediate part 28 brazed to the insulator 24 and to the shell 26. This process puts the ceramic insulator 24 in compression because of the differences in shrinkage of the components after the alloy solidifies and as the parts cool. During operation, the engine temperature does not reach the melting point of the braze alloy used to form intermediate part 28, so that it stays solid during engine operation. Alternatively, the intermediate part 28 could be formed by brazing the solid ring to the insulator 24 and shell 26 by another metal material, such as another metal having a lower melting point than the solid ring, using the brazing process described above.

Figure 2:
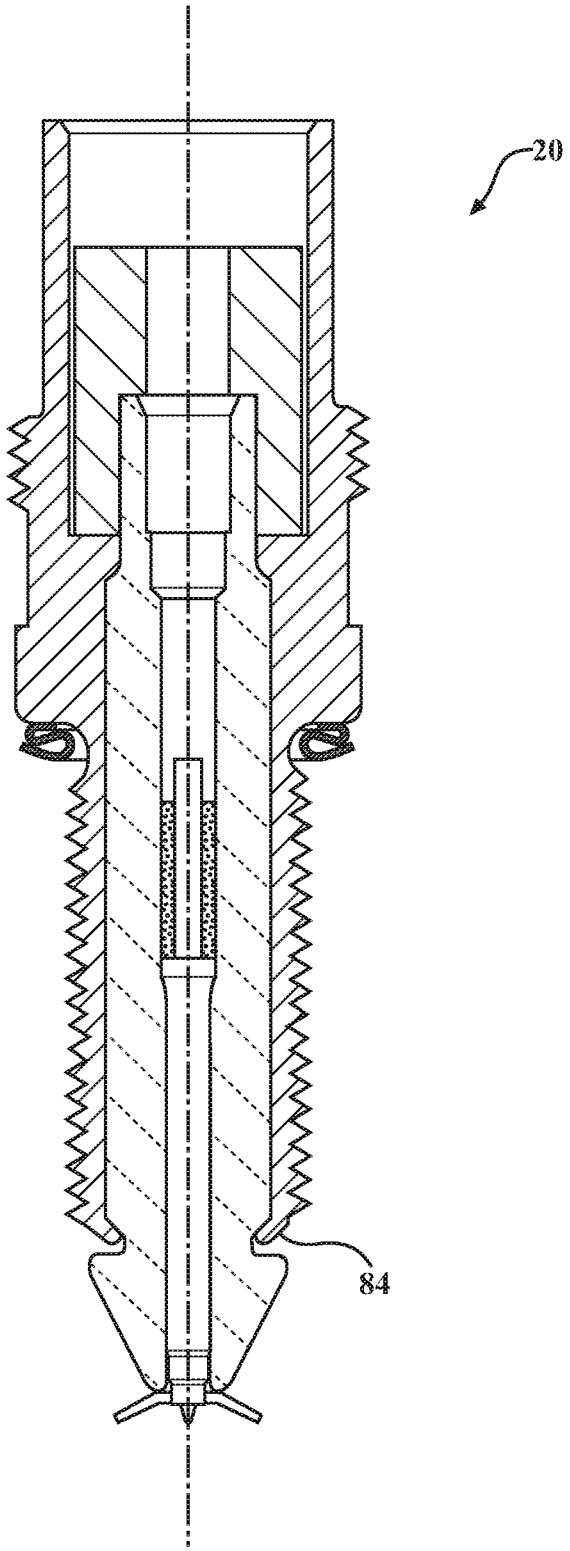
Figure 3:
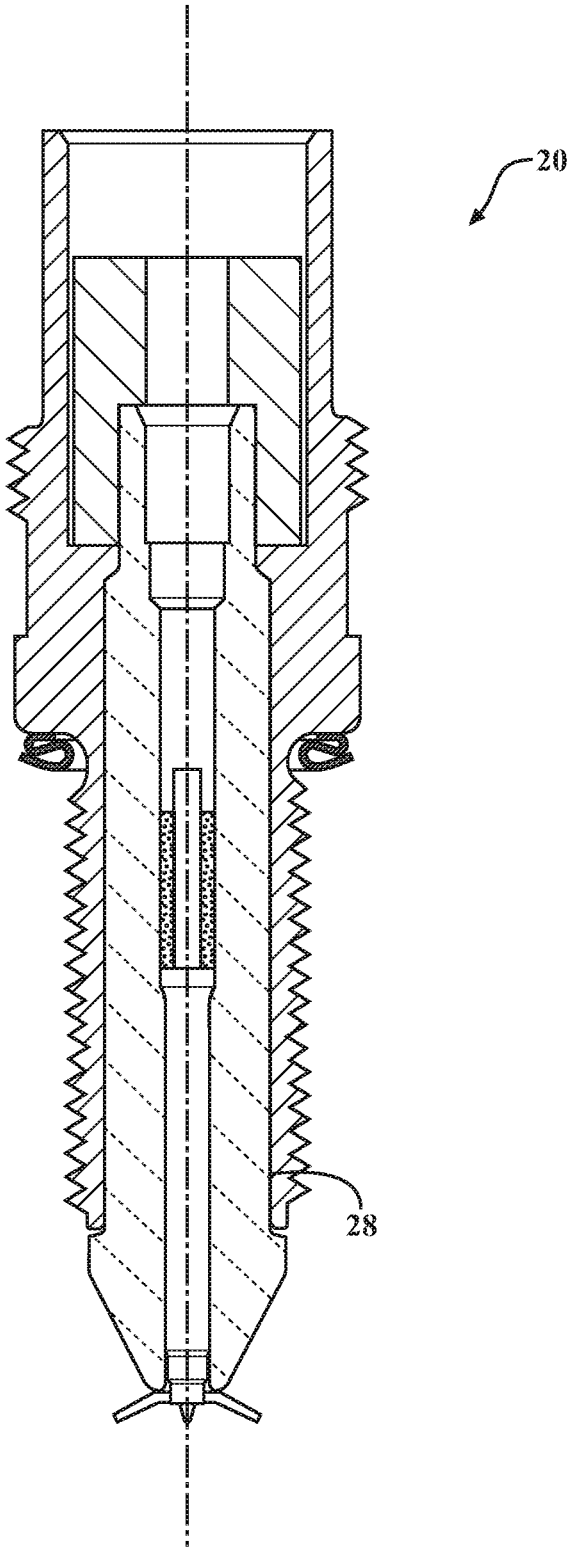
Figure 3A:
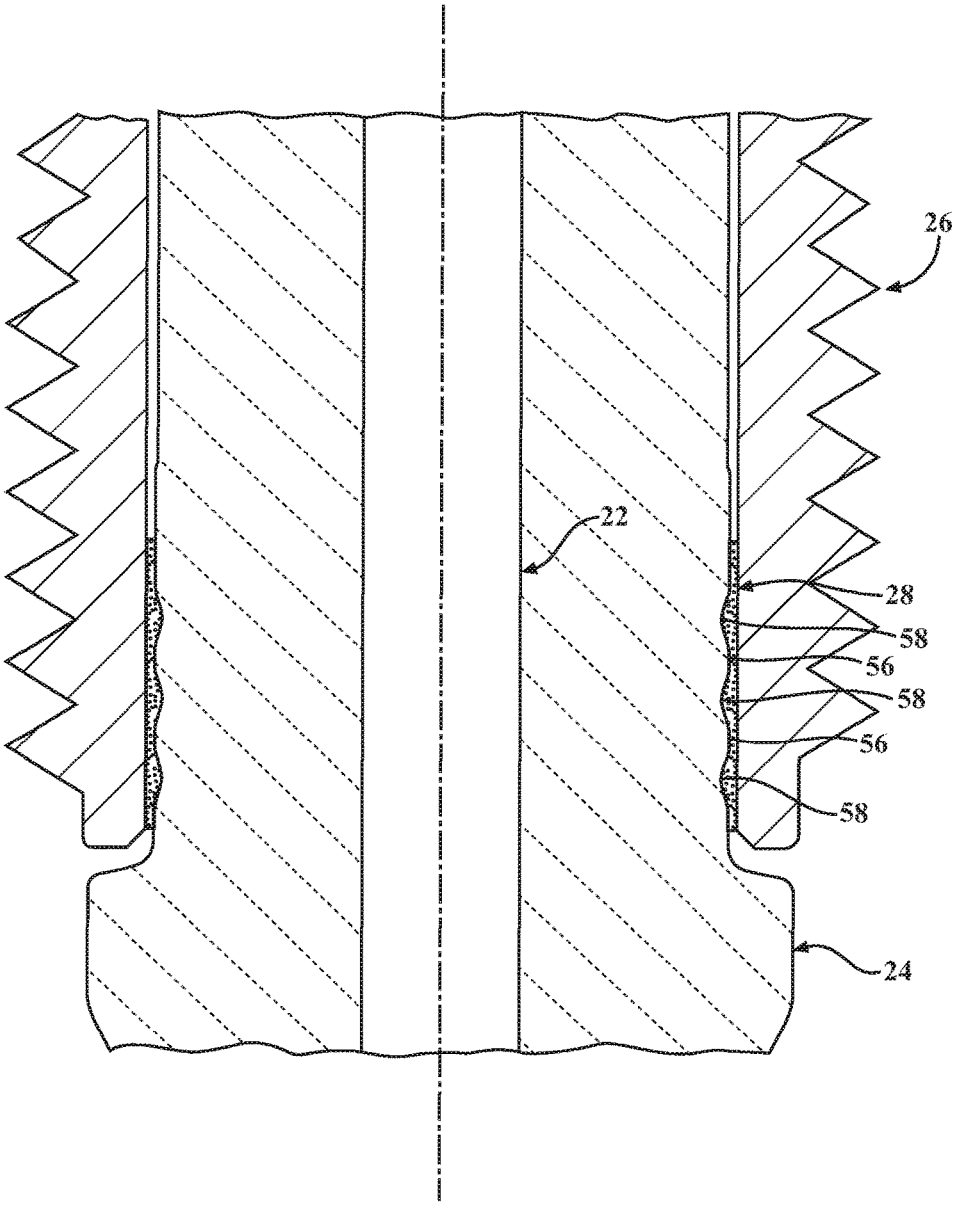
Figure 4:
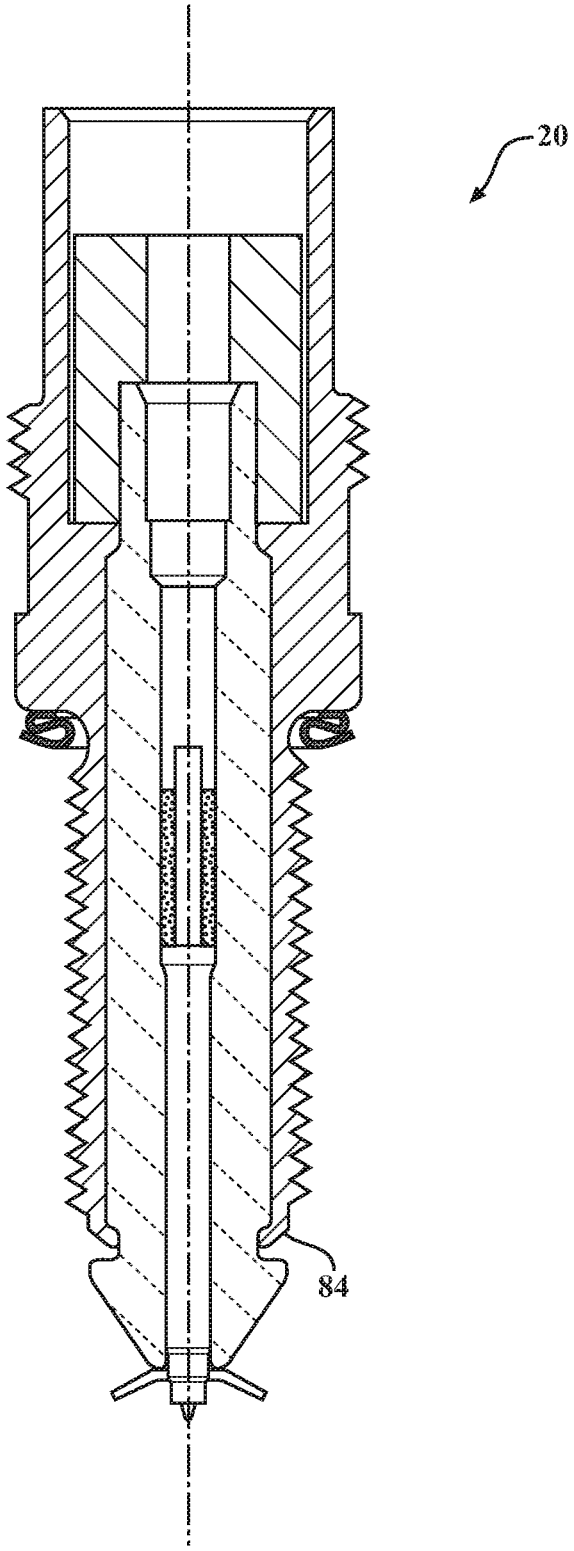

In addition to, or instead of, the intermediate part 28, the shell 26 can include a lower turnover flange 84 at the shell firing end 64, as shown in FIGS. 2 and 4-7, to help place the insulator 24 in compression. In the embodiment of FIG. 2, the lower turnover flange 84 is relatively thick and engages the middle ledge 52 of the insulator 24. In this embodiment, there is no intermediate part 28 located between the middle ledge 52 and the lower turnover flange 84, and the length of the insulator nose region is relatively long. In the embodiment of FIG. 4, the lower turnover flange 84 is also relatively thick and engages the middle ledge 52 of the insulator 24, but the length of the insulator nose region is shorter. In the embodiment of FIG. 5, the lower turnover flange 84 also engages the middle ledge 52 of the insulator 24, with no intermediate part 28 therebetween. In this embodiment, the lower turnover flange 84 is bolder and thus slightly longer and thicker than in other embodiments. In the embodiment of FIGS. 6 and 7, the lower turnover flange 84 of the shell 26 engages a lower end of the intermediate part 28. In each case wherein the shell 26 includes the lower turnover flange 84, the shell firing end 64 is disposed in the insulator groove 54 and remains spaced from the insulator lower shoulder 50. Alternatively, the shell firing end 64 could engage the insulator lower shoulder 50.

As stated above, the shell upper shoulder 70 or upper turnover flange 74, together with the groove 86, intermediate part 28, and/or lower turnover flange 84 of the embodiments of FIGS. 1-9 place the insulator 24 in compression therebetween. Typically, a compressive load ranging from 2 kN to 15 kN is placed on the insulator 24 prior to disposing the insulator 24 in an opening of the internal combustion engine, and the insulator 24 remains under compression even after being installed in the internal combustion engine. The mechanical strength of the insulator 24 under compression is higher than insulators placed under tension. For example, the strength of the insulator 24 typically ranges from 200 MPa to 600 MPa in tension and 3000 MPa to 4000 MPa in compression. Therefore, although the load placed on the insulator 24 after disposing the insulator 24 in the engine can range from compression to tension, it is desirable to keep the insulator 24 in compression during all aspects of the operating range. In the embodiment of FIG. 17, the insulator 24 is supported or mechanically fixed to the shell 26 at only one location between the insulator lower shoulder 50 and the insulator upper shoulder 48 and thus is not in compression or tension during assembly or after installed in the engine. Accordingly, the insulator 24 of FIG. 17 maintains exceptional strength.

Another aspect of the invention provides a method of manufacturing the reverse-assembled corona igniter 20 described above. The corona igniter 20 is typically reverse-assembled, in which case the method includes inserting the insulator upper end 38 through the shell firing end 64. In the embodiments of FIGS. 1-8, the insulator upper shoulder 48 is pressed against the shell upper shoulder 70. In the embodiment of FIG. 17, the insulator 24 is inserted through the shell firing end 64 until the insulator lower shoulder 50 engages the shell firing end 64. In the embodiments of FIGS. 9 and 14, the shell upper end 62 is bent inwardly toward the center axis A and over the insulator upper shoulder 48 to form the upper turnover flange 74 of the shell 26. This step is conducted after disposing the insulator 24 in the shell 26. In alternate embodiments, the corona igniter 20 can be designed for forward-assembly, in which case the method includes inserting the insulator nose end 40 into the shell upper end 62 before inserting the insulator upper end 38 through the shell upper end 62.

To form the embodiments of FIGS. 1, 3, 6-9 and 13, wherein the corona igniter 20 includes the intermediate part 28, the method includes securing the intermediate part 28 to the insulator 24 and/or shell 26 before or after disposing the insulator 24 in the shell 26. For example, the method of forming the corona igniter 20 of FIG. 1 can include simply placing the intermediate part 28 in the groove 54 of insulator 24, and then inserting the intermediate part 28 and insulator 24 together through the lower end of the shell 26. After the intermediate part 28 and insulator 24 are disposed in the shell 26, the intermediate part 28 is fixed to the shell inner surface 66, for example by brazing, welding, or press-fit. The method of forming the corona igniters 20 of FIGS. 6-8 can include brazing, soldering, or welding the intermediate part 28 to the insulator 24 before inserting the insulator 24 in the shell 26, and then optionally brazing, soldering or welding the intermediate part 28 to the shell 26. As discussed above, the intermediate part 28 can include a solid piece and then an additional braze to secure the solid piece to the insulator 24 and shell 26. The method of forming the corona igniter 20 of FIG. 3 includes securing the insulator 24 to the shell 26 using the intermediate part 28 after disposing the insulator 24 in the shell 26. In this embodiment, the method includes applying the intermediate part 28 in a small gap between the insulator 24 and shell 26 in the form of a liquid metal and then allowing the liquid metal to solidify. Alternatively, the method can include applying the liquid metal to the insulator 24 immediately before inserting the insulator 24 into the shell 26, and then allowing the liquid metal to solidify and braze the insulator 24 to the shell 26.

To form the corona igniter 20 of FIGS. 1, 4, and 5, the method further includes bending the shell firing end 64 inwardly toward the center axis A against the insulator lower shoulder 50 to form the lower turnover flange 84 of the shell 26. This step is conducted after disposing the insulator 24 in the shell 26. Alternatively, the method can include bending the shell firing end 64 against the lower end of the intermediate part 28 to form the lower turnover flange 84, as shown in FIGS. 6 and 8.

In the embodiment of FIG. 17, the layer of metal in liquid form is applied between the insulator outer surface 46 and the shell inner surface 66, and between the insulator lower shoulder 50 and the insulator upper shoulder 52 after the insulator 24 is inserted into the shell 26. Typically, the metal is melted and flows into the small gap between the insulator 24 and shell 26. The liquid metal is then allowed to cool and solidify to forming the intermediate part 28 which brazes the insulator 24 to the shell 26.

Obviously, many modifications and variations of the present disclosure are possible in light of the above teachings and may be practiced otherwise than as specifically described while within the scope of the following claims.

The invention claimed is:

1. A corona igniter for emitting a radio frequency electric field to ionize a fuel-air mixture and provide a corona discharge, comprising:

a central electrode formed of an electrically conductive material for receiving a high radio frequency voltage and emitting the radio frequency electric field;

an insulator formed of an electrically insulating material surrounding said central electrode and extending longitudinally from an insulator upper end to an insulator nose end;

said insulator including an insulator outer surface extending from said insulator upper end to said insulator nose end;

said insulator outer surface presenting an insulator outer diameter;

said insulator outer surface including an insulator lower shoulder extending outwardly and located between said insulator upper end and said insulator nose end;

said insulator lower shoulder presenting an increase in said insulator outer diameter;

a shell surrounding at least a portion of said insulator and extending from a shell upper end to a shell firing end;

said shell presenting a shell inner surface facing and extending along said insulator outer surface from said shell upper end to said shell firing end;

said shell inner surface presenting a shell inner diameter;

said shell inner diameter of at least one location of said shell being less than said insulator outer diameter at said insulator lower shoulder;

an intermediate part formed of an electrically conductive material disposed between said insulator outer surface and said shell inner surface and between said insulator upper end and said insulator lower shoulder.

2. The corona igniter of claim 1, wherein said insulator is supported only along said intermediate part so that said insulator is not in tension.

3. The corona igniter of claim 1, wherein said shell inner diameter at said shell firing end is less than said insulator outer diameter at said insulator lower shoulder.

4. The corona igniter of claim 1, wherein said intermediate part is a layer of metal securing said insulator outer surface to said shell inner surface.

5. The corona igniter of claim 4, wherein the layer of metal brazes the insulator outer surface to the shell inner surface.

6. The corona igniter of claim 1, wherein said intermediate part is a sleeve of metal extending circumferentially around said insulator.

7. The corona igniter of claim 6, wherein the intermediate part includes a layer of metal securing said sleeve of metal to said insulator outer surface and said shell inner surface.

8. The corona igniter of claim 1, wherein said insulator outer diameter decreases to present a middle ledge spaced from the increase in said insulator outer diameter at said insulator lower shoulder, said insulator includes a groove between said middle ledge and said insulator lower shoulder, and said intermediate part is disposed in said groove.

9. The corona igniter of claim 8, wherein said shell includes a lower turnover flange at said shell firing end, said lower turnover flange extends radially inwardly and into said groove of said insulator, and said intermediate part is disposed in said groove between said lower turnover flange and said insulator outer surface.

10. The corona igniter of claim 9, wherein said lower turnover flange is bent around said middle ledge.

11. The corona igniter of claim 1, wherein said intermediate part is fixed to said insulator outer surface and said shell inner surface.

12. The corona igniter of claim 1, wherein said intermediate part is a layer of metal, and said insulator outer surface presents a plurality of ribs with depressions therebetween along said intermediate part.

13. The corona igniter of claim 1, wherein said intermediate part is spaced from said insulator lower shoulder.

14. The corona igniter of claim 1, wherein said central electrode includes a corona enhancing tip disposed outwardly of said insulator nose end and including a plurality of prongs extending radially outwardly.

15. The corona igniter of claim 1, wherein said insulator extends longitudinally from said insulator upper end to an insulator upper shoulder and from said insulator upper shoulder to said insulator lower shoulder;

said insulator upper shoulder presents an increase in said insulator outer diameter;

said insulator outer diameter is constant from said insulator upper end to said insulator upper shoulder;

said insulator outer diameter is greater at said insulator upper shoulder than at said insulator upper end;

said insulator outer diameter is greater at said insulator lower shoulder than said insulator upper shoulder;

said insulator outer diameter decreases from said insulator lower shoulder to said insulator nose end;

said insulator is supported only along said intermediate part so that said insulator is not in tension and not in compression;

said shell firing end engages said insulator lower shoulder;

said shell inner diameter at said shell firing end is less than said insulator outer diameter at said insulator lower shoulder;

said intermediate part is a layer of metal which secures said insulator to said metal shell, said metal contains one or more of nickel, cobalt, iron, copper, tin, zinc, silver, and gold;

said central electrode includes a corona enhancing tip disposed outwardly of said insulator nose end and including a plurality of prongs extending radially outwardly.

16. A method of forming a corona igniter, comprising the steps of:

providing an insulator formed of an electrically insulating material extending from an insulator upper end to and insulator nose end, the insulator including an insulator outer surface extending from the insulator upper end to the insulator nose end and presenting an insulator outer diameter, the insulator outer surface presenting an insulator lower shoulder extending outwardly and located between the insulator upper end and the insulator nose end, the insulator lower shoulder presenting an increase in the insulator outer diameter;

providing a shell extending from a shell upper end to a shell firing end and including a shell inner surface presenting a shell bore, the shell inner surface presenting a shell inner diameter, the shell inner diameter of at least one location of the shell being less than the insulator outer diameter at the insulator lower shoulder;

inserting the insulator upper end into the shell bore through the shell firing end; and disposing an intermediate part formed of an electrically conductive material between the insulator outer surface and the shell inner surface.

17. The method of claim 16, including supporting the insulator only along the intermediate part so the insulator is not in tension.

18. The method of claim 16, wherein the step of disposing the intermediate part between the insulator outer surface and the shell inner surface includes brazing the insulator outer surface to the shell inner surface.

19. The method of claim 16, wherein the step of disposing the intermediate part between the insulator outer surface and the shell inner surface includes disposing a solid piece of metal around the insulator, and brazing the solid piece of metal to the insulator outer surface and to the shell inner surface.

20. The method of claim 16 including engaging the shell firing end with the insulator lower shoulder.

21. The method of claim 16, wherein the insulator outer diameter decreases to present a middle ledge spaced from the insulator lower shoulder, the insulator includes a groove between the middle ledge and the insulator lower shoulder, and the step of disposing the intermediate part between the insulator outer surface and shell inner surface includes disposing the intermediate part in the groove.

22. The method of claim 20, wherein the shell includes a lower turnover flange at the shell firing end, and bending the lower turnover flange into the groove.

* * * * *